US006776671B2

(12) United States Patent
Dunn

(10) Patent No.: US 6,776,671 B2
(45) Date of Patent: Aug. 17, 2004

(54) TROLLING MOTOR STEERING LINKAGE SYSTEM

(76) Inventor: Scott E. Dunn, 3451 Oakhill Dr., North Liberty, IA (US) 52317

( * ) Notice: Subject to any disclaimer, the term of this patent is extended or adjusted under 35 U.S.C. 154(b) by 0 days.

(21) Appl. No.: 10/315,388

(22) Filed: Dec. 10, 2002

(65) Prior Publication Data

US 2004/0110431 A1 Jun. 10, 2004

(51) Int. Cl.[7] ..... B60L 11/02
(52) U.S. Cl. ..... 440/6; 440/63
(58) Field of Search ..... 440/6, 7, 53, 59, 440/63; 114/162, 61.1

(56) References Cited

U.S. PATENT DOCUMENTS

| | | | | |
|---|---|---|---|---|
| 1,898,150 A | * | 2/1933 | Stover et al. | 440/63 |
| 2,365,490 A | * | 12/1944 | Pieron | 440/63 |
| 4,565,529 A | | 1/1986 | Aertker et al. | |
| 4,909,765 A | * | 3/1990 | Riske et al. | 440/59 |
| 4,916,969 A | | 4/1990 | Henning | |
| 4,950,187 A | * | 8/1990 | Smith | 440/7 |
| 5,131,875 A | | 7/1992 | Lee | |
| 5,453,030 A | | 9/1995 | Broussard | |
| 5,564,956 A | | 10/1996 | McDavid | |
| 5,660,132 A | | 8/1997 | Pasley | |
| 6,053,781 A | | 4/2000 | Littleton | |

* cited by examiner

*Primary Examiner*—Stephen Avila
(74) *Attorney, Agent, or Firm*—Jones Waldo Holbrook & McDonough, PC; Brent T. Winder; Wade W. Sherman

(57) ABSTRACT

A trolling motor steering linkage system with motor steering and speed controls mounted adjacent to a central or midship portion of a boat for ease of one-hand operability. The steering linkage system is mounted to a top surface or hull of a boat via a propeller tube, secured to a transom which spans the width of the craft and provides support for the propeller tube. A motor control head controls the direction and the speed of the trolling motor with an integrally attached grip throttle. A roll bar is attached to the motor control head, which roll bar is supported at a raised elevation from the mounting surface of the boat by roll bar stantions. The roll bar is further connected to a linkage rod, which linkage rod is connected to the propeller tube for rotating the propeller tube, with attached trolling motor and propeller, and thereby steers the boat.

5 Claims, 3 Drawing Sheets

TROLLING MOTOR STEERING LINKAGE SYSTEM

BACKGROUND OF THE INVENTION

1. Field of the Invention

The present invention relates generally to a steering device for an electric powered trolling motor. Specifically, the present invention relates to a method and apparatus for steering a water craft, and more particularly a one-man pontoon boat, via an electric trolling motor from a remote location within the craft by employing a mechanical linkage mechanism mounted integrally to the water craft.

2. Background and Prior Art

The use of various types of electric trolling motors to propel and steer various types water craft is well known. More particularly, the use of trolling motors with water craft used for fishing or hunting is widely recognized and utilized as an effective method of navigating a body of water. Often, these motors are attached to the stem of a boat within reach of the operator, so that the operator can have ultimate control over the operation of the motor. Alternatively, these motors are equipped with remote steering controls to enable the operator to steer the boat from an aft or midship portion of the boat he/she is operating.

However, the prior art remote steering mechanisms have several common problems. For example, much of the prior art requires the operator to sit in a stern portion of the boat, or to rotate or bend backwards, in order to reach the extended handle of the trolling motor. Other prior art requires the operator to use two hands to control the speed of the motor and steer at the same time.

Further, other prior art requires the use of foot pedals to control and steer the motor which may become difficult when the operator needs to shift weight within the boat or to stand. The prior art also mainly teaches the application of remotely steerable trolling motors primarily over single hull crafts, which are difficult for the operator to mount and/or dismount when necessary. All of the identified problems, and others not discussed, may be compounded by trying to adapt a trolling motor linkage system to a small pontoon boat as taught and claimed by the present illustrated embodiments.

The following United States patents are herein incorporated by reference for their supporting teachings:

1) U.S. Pat. No. 4,565,529 issued to Aertker et al. discloses a control mechanism for a boat having a seat assembly to support a pilot and outboard motor which is directionally controlled by extension and retraction of a cable with the control mechanism having a pedal which is generally planar on its upper surface receptive of the pilot's foot;
2) U.S. Pat. No. 5,564,956 issued to McDavid discloses a steering and speed control mechanism for a hand-controlled trolling motor. The mechanism includes a yoke assembly having a first section attached to the trolling motor and a second section hingedly attached to the first section;
3) U.S. Pat. No. 4,916,969 issued to Henning discloses an attachable steering handle for an electric trolling motor that includes a swivel, an adaptive shaft connected to the swivel, and a control handle shaft connected to the swivel;
4) U.S. Pat. No. 5,660,132 issued to Pasley discloses a device for adjusting the position of a trolling motor relative to a boat which has an arm, preferably Lshaped, with one end connected to the steering column of the trolling motor. The other end is higher than the first end and rotatably connected to an end of a handle bar, which is adapted to cause the arm to rotate with the steering column;
5) U.S. Pat. No. 5,131,875 issued to Lee discloses a propulsion and steering system for dual motors mounted to a boat, especially of the trolling type, which incorporates a pair of foot pedals which are electrically connected between a battery and the motors and which are operable to independently control the direction of thrust and speed of the motors;
6) U.S. Pat. No. 6,053,781 issued to Littleton discloses an auxiliary steering device for a trolling motor employing a steering block attached to the directional shaft of the trolling motor that is connected via a continuous cable to a pivoting stick positioned on the gunwale of a boat; and
7) U.S. Pat. No. 5,453,030 issued to Broussard discloses an auxiliary steering handle apparatus adaptable to most boat mounted trolling motors. The apparatus is comprised of two main components, the pivotal telescopic handle or lever and a split gear housing or case.

SUMMARY OF THE INVENTION

The present invention relates to a steering linkage system for electric trolling motors to aid boat operators in steering a boat from a central or midship portion of the boat, particularly pontoon based boats. Potential features of the present invention are to provide a trolling motor steering linkage apparatus which allows the operator to control the steering and speed of the motor with one hand, which allows the operator to sit in a central or midship portion of the boat, and which is suitable for installation over a pontoon based boat to facilitate maneuverability and ease of mounting and dismounting of the operator.

Yet, another potential feature of the present invention may be to incorporate the use of a trolling motor steering linkage system; wherein, the hand controls are mounted adjacent to a central or mridship portion of a boat for ease of one-hand operability.

Additional features and advantages of the invention will be set forth in the detailed description which follows, taken in conjunction with the accompanying drawings, which together illustrate by way of example, the features of the invention.

BRIEF DESCRIPTION OF THE DRAWINGS

In view of these objects which will become more readily apparent as the nature of the invention is better understood, the invention consists of the novel combination of parts, hereinafter more fully described with like numbers corresponding to like elements between drawings, illustrated and claimed with reference to the appended figures, wherein:

DETAILED DESCRIPTION OF THE ILLUSTRATED EMBODIMENT

Figure 1:
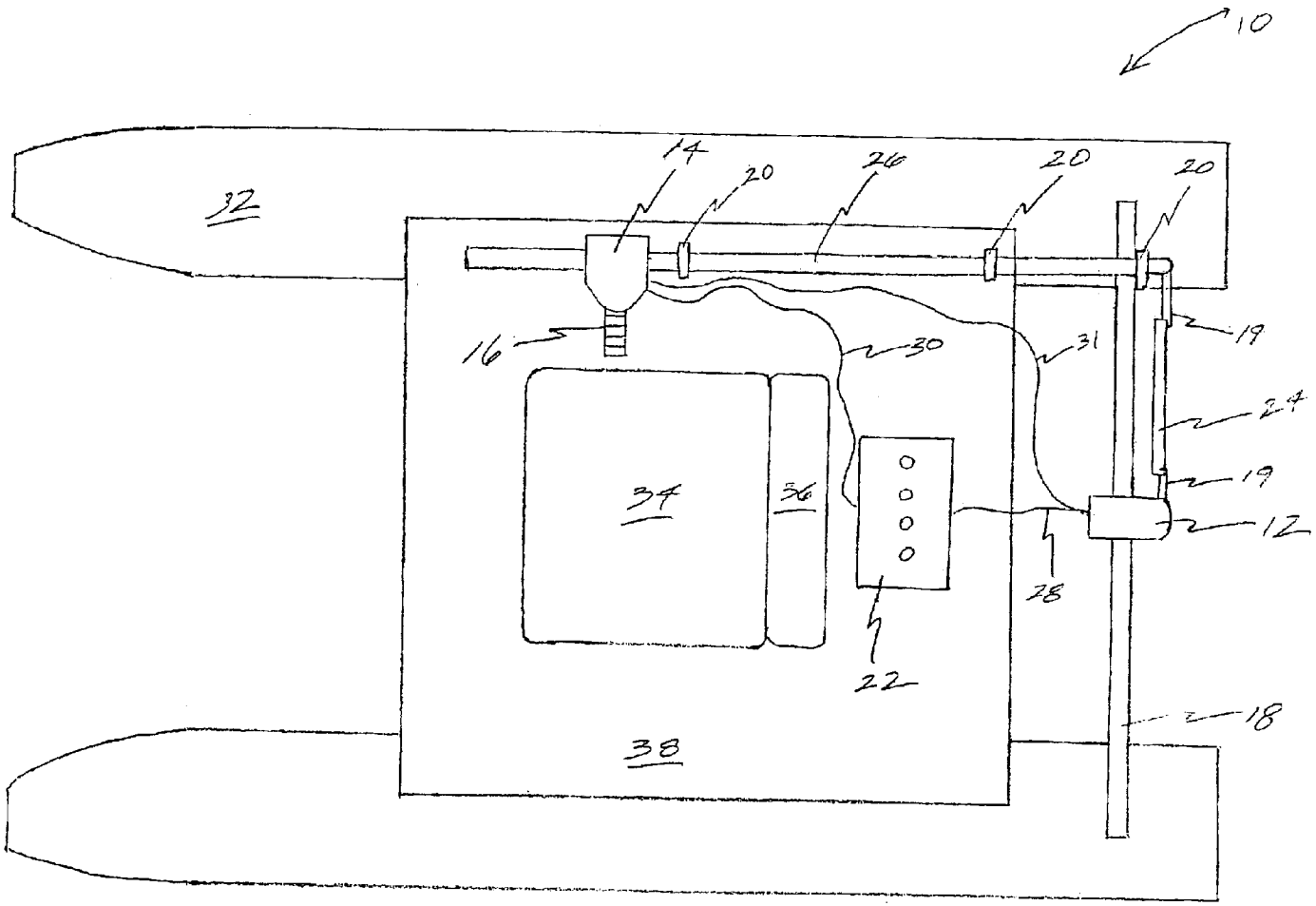
FIG. 1 is a top plan view of an illustrated embodiment of a trolling motor steering linkage system 10 as applied to a pontoon based boat.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

The present invention is used in the typical environment in which electric trolling motors, specifically pontoon mounted trolling motors, are utilized by boat operators, but where it may be advantageous to provide a trolling motor linkage system that: allows the operator to control the steering and speed of the motor with one hand, allows the operator to sit in a central or midship portion of the boat, and is suitable for installation over a pontoon based boat to facilitate maneuverability and ease of mounting and dismounting of the operator. Some advantages over the prior art may lie principally in that the present invention accomplishes the aforementioned tasks by providing a trolling motor steering linkage system, wherein; the hand controls are mounted adjacent to a central or midship portion of a boat for ease of one-band operation.

Referring now to FIG. 1, there is shown top plan view of an illustrated embodiment of a trolling motor steering linkage system 10 (hereinafter referred to as the "linkage system") as applied to a pontoon based boat. Specifically, the linkage system 10 is mounted atop two elongated buoyant pontoons 32 which are preferably parallel to each other in orientation. The pontoons 12 are connected by a base platform 38, which is fastened to a top side, or sky facing side, of the pontoons 12. There is mounted atop the base platform 38 a seat 34 and seat back 36 for an operator to sit while operating the boat.

FIG. 1 also shows a propeller tube 12 secured to a transom 18, which spans the pontoons 32 and provides support for the propeller tube 12. Extending from, and within, the propeller tube 12 is a motor power wire 28 and a throttle control wire 31 for providing power to a trolling motor (see reference number 41 of FIG. 2) and for controlling the speed of the motor respectively. The motor power wire 28 is connected to a battery 22 on one end and to the trolling motor (see reference number 41 of FIG. 2) on an opposite end. Also connected to the battery 22 on one end, is a throttle control power wire 30, which is connected on an opposite end to a motor control head 14. The motor control head 14 controls the direction (forward or reverse) of the trolling motor (see reference number 41 of FIG. 2) and the speed of the motor through a grip throttle 16.

FIG. 1 additionally illustrates a system for linking the motor control head to the trolling motor (see reference number 41 of FIG. 2) with a roll bar 26 attached to the motor control head 14, which roll bar 26 is supported at a raised elevation from a top surface of the pontoons 32 by roll bar stanchions 20. The roll bar 26 is connected to a linkage rod 24 via a displacement compensation member 19. An identical linkage rod 19 is also utilized to connect the linkage rod 24 to the propeller tube 12 for rotating the propeller tube 12 and steering the boat. As an operator (not shown) rotates the motor control head 14 along a vertical axis, the roll bar 26 similarly rotated within the roll bar stanchions 20, thereby either pushing or pulling the linkage rod 24 depending on the direction of the vertical rotation of the motor control head 14. Thus, as the linkage rod 24 is moved in a horizontal direction, the propeller tube 12 is rotated to steer the trolling motor (see reference number 41 of FIG. 2) in either direction.

Figure 2:
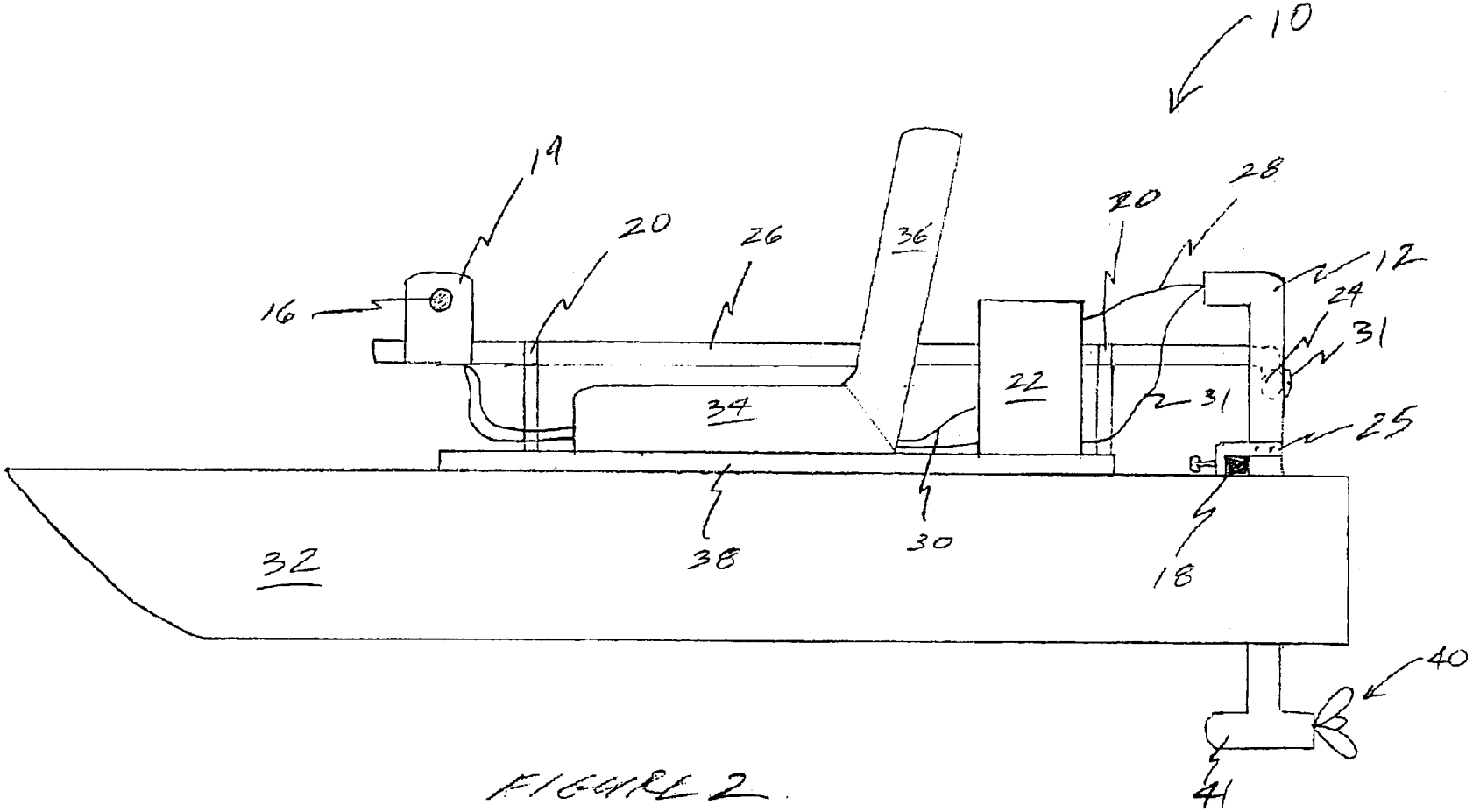
FIG. 2 is a side view of an illustrated embodiment from FIG. 1.

Referring now to FIG. 2, which is a side view of an illustrated embodiment of the linkage system 10, there is shown a transom clamp 25 for securing the propeller tube 12 to the transom 18. A propeller 40 is also shown, as attached to the trolling motor 41.

Figure 3:
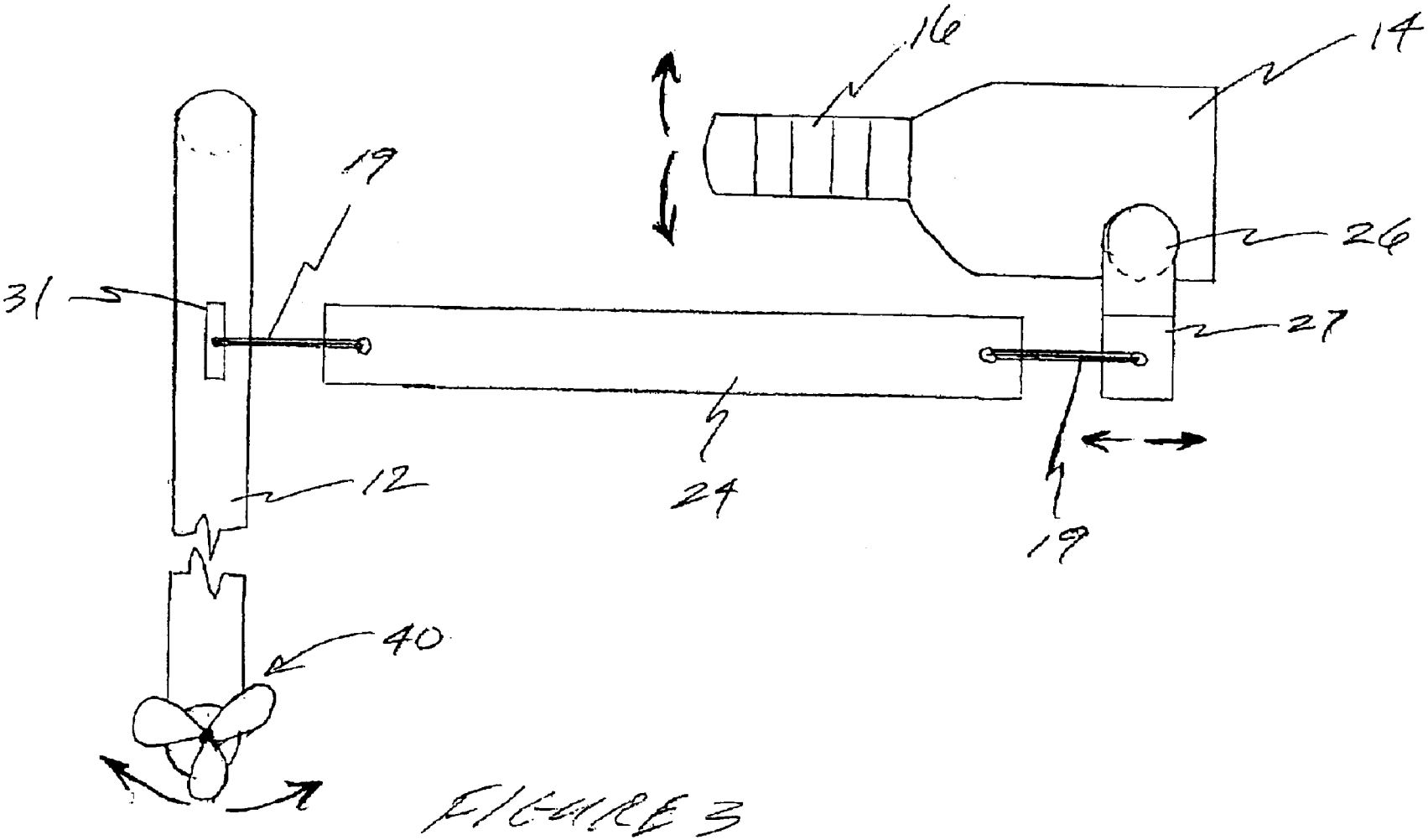
FIG. 3 is a rear view of the trolling motor steering linkage system 10 from FIG. 1.

Referring now to FIG. 3, which is a rear view of the linkage system 10, there is shown a roll bar coupling 27, affixed to the roll bar 26 for extending the roll bar 26 in a downward and vertical direction. The roll bar coupling 27 allows for optimal horizontal displacement of the linkage rod when the roll bar 26 is rotated in either direction. The linkage rod 24 is hingedly attached to the roll bar coupling via a displacement compensation member 19, which compensates for vertical displacement of the roll bar coupling 27 during rotation (due to the natural upward displacement of the roll bar coupling 27 during rotation). Similarly, there is another displacement compensation member 19 connecting the linkage rod 24 to the propeller tube 12, via a tube extension bracket 31, which connection allows for horizontal displacement of the propeller tube 12 during rotation (due to the cylindrical shape of the propeller tube 12).

VARIATIONS OF THE ILLUSTRATED EMBODIMENT(S)

It is understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. For example, in addition to the illustrated configuration, it is noted that the linkage system may also be assembled to facilitate a left handed operator. The roll bar stanchions, roll bar, linkage rod, and displacement compensation members may be installed on a left side of the boat as well as a right side. Similarly, variations in the size, and location of the operator's seat and seat back within the boat are also contemplated. For example, the seat may be located at an extreme aft position or an extreme stem position within the boat to accommodate the particular needs of an operator.

One skilled in the art would recognize that any number of conventional fastener types or shapes would be appropriate to connect the base platform to the pontoons, the roll bar stanchions to the base platform or pontoons, and the transom to the pontoons. For example, a simple nut and bolt connection is contemplated. Alternatively, a hinge connection is also envisioned. Similarly, the securing of the battery to the base platform may be achieved by any number of connection methods as recognized by one skilled in the art. For example, battery straps connected to the base platform with nut and bolt fasteners which are then wrapped around the battery are contemplated.

In addition, as one skilled in the art would easily recognize after reviewing the present embodiment(s), the location of the motor control head on the roll bar may be variable depending on the location of the operator's seat. For example, the motor control head may be locked to an extreme end of the roll bar, or to a mid-portion of the roll bar.

Although the illustrated embodiment has generally been discussed using a pontoon based boat, a skilled artisan of the water craft art will easily contemplate many other applications. For example, the present embodiment could easily be used for single hull crafts as well as pontoon based boats.

Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A trolling motor steering linkage system, comprising:

a) a motor control head, having a cylindrical shaped hollow core;

b) a roll bar, upon which the motor control head is slidably mounted, the roll bar fitting inside the cylindrical shaped hollow core of the motor control head;

c) a set of roll bar stanchions, having ring shaped upper portions, within which the roll bar is rotatable mounted;

d) a water craft, upon which the set of roll bar stanchions are removably attached;

e) a linkage rod, attached to the roll bar;

f) a propeller tube, attached to the linkage rod;

g) first and second displacement compensation members, which first displacement compensation member connects the roll bar to the linkage rod and which second displacement compensation member connects the propeller tube to the linkage rod; and h) a trolling motor and propeller, integrally connected to a bottom portion of the propeller tube.

2. The trolling motor steering linkage system of claim 1, wherein the motor control head includes:

a) a grip throttle, attached to a proximate portion of the motor control head;

b) a propeller rotation reversing switch, integrally attached to a portion of the motor control head;

c) a roll bar clamp, located adjacent to the tube shaped hollow portion of the motor control head, removably securable to the roll bar at any desired position along a length of the roll bar; and d) a throttle control power wire, connected to a power supply, and a throttle control wire, connected to the trolling motor.

3. The trolling motor steering linkage system of claim 1, wherein the propeller tube is removably and vertically attached to the water craft upon a horizontal transom with an adjustable transom clamp.

4. A method for controlling the position of a water craft with a trolling motor steering linkage system, the method comprising the steps of:

a) rotating a motor control head, which is removably attached to a roll bar, in an upward or downward direction;

b) rotating the roll bar in a clockwise or counter clockwise direction by rotating the motor control head upward or downward respectively, which roll bar is mechanically attached to a linkage rod;

c) pushing or pulling the linkage rod in a left or right horizontal direction by rotating the roll bar in a clockwise or counter clockwise direction respectively, which linkage rod is mechanically attached to a propeller tube;

d) rotating the propeller tube in a clockwise or counter clockwise direction by pushing or pulling the linkage rod respectively, which propeller tube is integrally attached to a trolling motor and propeller; and e) controlling the direction of the propeller's rotation and speed of rotation by rotating a grip throttle, which is attached to the control motor head.

5. A trolling motor steering linkage system, comprising;

a) a pontoon boat, having at least two pontoons;

b) a base platform, removably secured to a top surface of the pontoons and connecting the pontoons together;

c) a seat and seat back, removably secured to a top surface of the base platform;

d) a set of roll bar stanchions, having ring shaped upper portions, secured to a top surface of the base platform and pontoons;

e) a roll bar, mounted within the ring shaped upper portion of the roll bar stanchions;

f) a motor control head, slidably mounted to an end of the roll bar;

g) a linkage rod, attached to an opposite end of the roll bar;

h) a propeller tube, attached to the linkage rod; and i) a trolling motor and propeller, integrally attached to the propeller tube.

* * * * *